United States Patent [19]

Küger et al.

[11] 4,297,664

[45] Oct. 27, 1981

[54] ELECTROMAGNETIC OVERCURRENT TRIPPING DEVICE WITH ADJUSTABLE ARMATURE AIR GAP

[75] Inventors: Manfred Küger; Wolfgang Nawrot; Bernhard Preüss, all of Berlin, Fed. Rep. of Germany

[73] Assignee: Siemens Aktiengesellschaft, Berlin and Munich, Fed. Rep. of Germany

[21] Appl. No.: 24,511

[22] Filed: Mar. 28, 1979

[30] Foreign Application Priority Data

Apr. 5, 1978 [DE] Fed. Rep. of Germany ..... 2815130

[51] Int. Cl.[3] ..... H01H 69/01

[52] U.S. Cl. ..... 335/176; 335/42

[58] Field of Search ..... 335/176, 42, 274, 273, 335/272

[56] References Cited

U.S. PATENT DOCUMENTS 3,652,961 3/1972 Salvati et al. ..... 335/176

*Primary Examiner*—Harold Broome

*Attorney, Agent, or Firm*—Kenyon & Kenyon

[57] ABSTRACT

A low voltage circuit breaker has an electromagnetic overcurrent tripping device consisting of a magnetic yoke, relative to the pole surfaces of which an armature is movably arranged. The spacing of the armature from the pole surfaces is established by a stop member carried on a stationary support. The stop member is in the form of a disc having pairs of pins on its opposite sides which are mounted on connecting lines which are perpendicular to each other. Which of the four stop surfaces of the stop member is set in place is decided by rotating the stop member by 180° when it is facing one way or by reversing it, and rotating it 180° in its new position to choose between the other surfaces. Both sides of the stop member carry markings for the tripping current level, the effective one being always readable in the upright position.

5 Claims, 6 Drawing Figures

ELECTROMAGNETIC OVERCURRENT TRIPPING DEVICE WITH ADJUSTABLE ARMATURE AIR GAP

BACKGROUND OF THE INVENTION

1. Field of the Invention

This invention relates to an electromagnetic overcurrent tripping device for electric circuit breakers having a stationary magnetic yoke and an armature arranged movably relative thereto in which the distance of the armature from the surfaces of the poles of the magnetic yoke can be varied for setting different tripping currents.

2. Discussion of the Prior Art

A tripping device of this type is described, for instance, in U.S. Pat. No. 3,526,861. There, the distance of the armature from the pole surfaces of the magnetic yoke is adjusted by a plunger which can be actuated by a setting member which is adjustable at the housing of the circuit breaker. In contrast thereto, it is an object of the invention to provide a setting device for the armature which uses as few parts as possible and permits adjustment of the armature to a predetermined number of fixed tripping current levels.

SUMMARY OF THE INVENTION

According to the present invention, this problem is solved by providing a stop member which is supported in stationary position and which can be oriented in several directions to provide means for changing the distance of the armature from the pole surfaces of the magnetic yoke. In addition, the stop member is accessible for setting the tripping current only when the breaker is open. When the housing of the circuit breaker is closed, the stop member is not accessible and is therefore unavailable for unauthorized intervention.

The stop member is provided with several stop surfaces at different distances from a fastening point. The number of stop surfaces depends on the number of different tripping current values to be set.

The stop member incorporates an eccentric positioning arrangement which permits it to be removed from its mounting, rotated, and repositioned to establish the desired spacing of the stop surfaces from the fastening point. In one embodiment, pairs of pins project outwardly from, and perpendicular to, the parallel surfaces of the stop member, but lying in different planes. When a pair of pins is inserted in the associated mounting, a particular stop surface is positioned. When a different trip current level is desired, the stop is rotated 180°, and, because of the eccentric relationship between the stop and its fastening, another spacing is established. Instead of pin pairs, the stop member may be removably positioned via a formlocked, anti-rotational pin and an eccentric hole which receives it, thereby positioning the desired one of several stop surfaces.

Particularly easy handling is possible with a stop member taking the form of a cross-shaped disc having four stop surfaces corresponding to four different tripping current levels and which also carries current level markings, each of which becomes visible when in the upright position.

DETAILED DESCRIPTION OF THE INVENTION

Figure 1:
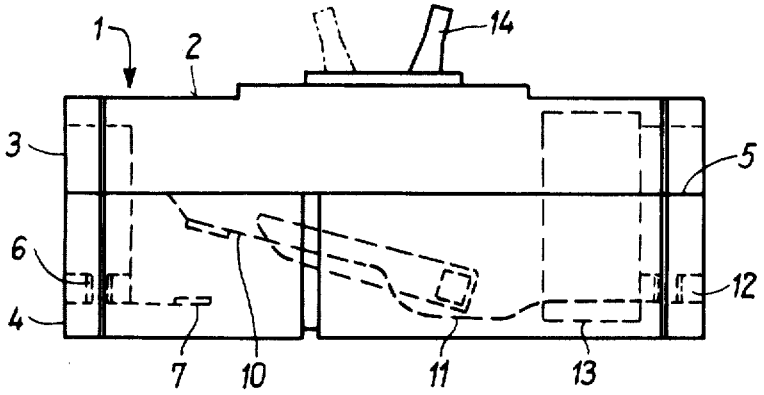
FIG. 1 is a side view showing, diagrammatically, a low voltage circuit breaker showing the location of the tripping device.

The low voltage circuit breaker 1 of FIG. 1 has a housing 2 of molded plastic insulating material which consists of an upper part 3 and a lower part 4. The housing is separable on the parting line 5 between upper part 3 and lower part 4. The path taken by the current path in circuit breaker 1 is indicated schematically in FIG. 1 by the dashed lines. It passes from a connecting device 6 to a stationary contact 7 and then, via a movable contact 10 and a flexible conductor ribbon 11, to another connecting device 12. A tripping device 13 is arranged in the path of the current between conductor ribbon 11 and connecting device 12. An operating handle 14 protrudes from upper part 3 of insulating housing 2 and serves for operating the circuit breaker 1 by hand.

Figure 2:
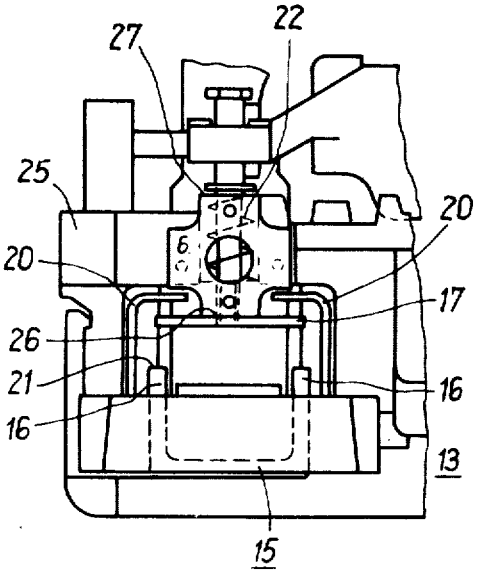
FIG. 2 is a side view of an electromagnetic overcurrent tripping device having a stop member according to the invention.
Figure 3:
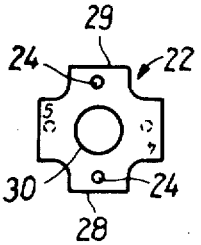
FIGS. 3, 4 and 5 shows the stop member of FIG. 2 in different positions.
Figure 4:
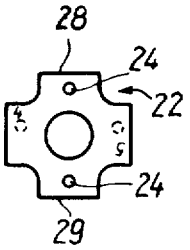
Figure 5:
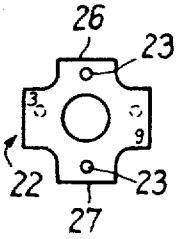

As shown in FIG. 2, tripping device 13 includes a magnetic yoke 15 having upward extending pole legs 16. Pole legs 16 cooperate with a lifting armature 17, which interacts, for example, with the switching mechanism of circuit breaker 1 in the manner shown in the above-mentioned U.S. Pat. No. 3,526,861. Magnetic yoke 15 also has auxiliary legs 20 which exert a magnetic pull-back force on the armature 17.

Figure 6:
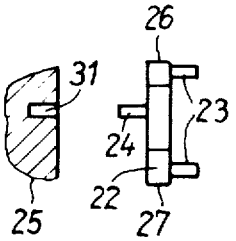
FIG. 6 shows detail of the stop member, posts, and eccentric opening.

The spacing of armature 17 from surfaces 21 of pole legs 16 is determined by a stop member 22 which is in the form of an approximately cross-shaped disc. Stop member 22 carries two pins 23 and two pins 24 on either face, the sets of pins being oriented on mutually perpendicular connecting lines. Thus, the side view of FIG. 6 has both pins 23 visible, but the profile of only one pin 24 can be seen. Receiving openings 31 (FIG. 6) fitting the diameter of pins 23 and 24 are located in a carrier 25 which is arranged in fixed position next to magnetic yoke 15.

Stop member 22 has four stop surfaces 26, 27, 28 and 29, which provide different distances from the fastening plane established by the pins 23 or 24, respectively. In FIG. 2, stop member 22 is so oriented that stop surface 26 is effective. This results in the greatest distance between armature 17 and pole surfaces 21 and therefore, in the highest tripping current. The smallest tripping current can be obtained by a 180° rotation of stop member 22 by 180°, placing stop surface 27 down and at the greatest distance from mounting pin holes 31. In both these positions of stop member 22, pins 23 are placed in the pin holes. Two further tripping currents can be set by reversing stop member 22 and plugging pins 24 into the holes in support 25. Depending on the position of stop member 22, stop surface 28 or stop surface 29 is effective to set still another pair of spacings. In FIGS. 2 to 5, the numbers 3 to 6 are exposed on the stop member; they identify the tripping current level. As will be seen, the appropriate effective current is readable in the upright position in FIG. 2; this corresponds to the direction of view when putting stop member 22 in place.

As can readily be visualized by study of FIGS. 2 to 6, it is also possible to provide stop members with a larger or smaller number of stop surfaces. It is then merely necessary to provide the appropriate number of pins on the stop member for attaching it to fixed support 25. Also the opening 30 in stop member 22 can be used for positioning the stop surfaces by providing appropriate, different distances between the center of the hole and the surfaces.

What is claimed is:

1. In an electromagnetic overcurrent tripping device for electric circuit breakers having a stationary magnetic yoke with associated pole surfaces, an armature which is supported for motion relative to the pole surfaces, and means for changing the spacing between the pole surfaces and the armature to provide different tripping current levels, the improvement comprising:

the means for changing the spacing comprising a removable armature stop member and a support means for fixing the position of the removable stop member relative to the pole surfaces, the removable stop member being mounted on the support means in one of a number of predetermined positions to establish a corresponding spacing of the armature relative to the support means.

2. In an overcurrent tripping device in accordance with claim 1, the further improvement comprising:

the removable armature stop member being disc-shaped and having a fastening point for mounting on the support means and having a plurality of stop surfaces, each stop surface being at a different distance from the fastening point.

3. In an overcurrent tripping device in accordance with claim 2, the further improvement comprising:

the support means comprising a stationary post; and the disc-shaped removable armature stop member having a hole at the fastening point for mounting on the post.

4. In an overcurrent tripping device in accordance with claim 2, the further improvement comprising:

the disc-shaped removable armature stop member having two sides and having a pair of carry pins projecting from each side, the pins being mounted perpendicular to a plane of the removable stop member so that a line lying in the plane and connecting the pins on one side of the removable stop member is perpendicular to another line lying in the plane and connecting the other set of pins; and holes in the support means for receiving one pair of the carry pins.

5. In an overcurrent tripping device in accordance with any one of claims 2, 3, or 4, the further improvement comprising:

the disc-shaped removable armature stop member being cross-shaped and having four stop surfaces corresponding to four tripping current levels; and four markings on the removable stop member, each associated with a stop surface and each stating the effective level of tripping current established by use of the associated stop surface, each marking being so placed that it is visible when the removable stop member is mounted on the support means.

* * * * *